US011395526B1

(12) United States Patent
Houston, III

(10) Patent No.: US 11,395,526 B1
(45) Date of Patent: Jul. 26, 2022

(54) SHOE INSERT

(71) Applicant: Telfair W. Houston, III, Atlanta, GA (US)

(72) Inventor: Telfair W. Houston, III, Atlanta, GA (US)

( * ) Notice: Subject to any disclaimer, the term of this patent is extended or adjusted under 35 U.S.C. 154(b) by 0 days.

(21) Appl. No.: 17/554,116

(22) Filed: Dec. 17, 2021

Related U.S. Application Data

(60) Provisional application No. 63/279,937, filed on Nov. 16, 2021.

(51) Int. Cl.

| | |
|---|---|
| ***A43B 23/08*** | (2006.01) |
| ***A43B 7/32*** | (2006.01) |
| ***A43B 23/02*** | (2006.01) |
| ***A43B 19/00*** | (2006.01) |

(52) U.S. Cl.
CPC ..... *A43B 19/00* (2013.01)

(58) Field of Classification Search
CPC ..... A43B 19/00; A43B 23/081; A43C 13/14
USPC ..... D2/909; 36/72 R, 77 R
See application file for complete search history.

(56) References Cited

U.S. PATENT DOCUMENTS

| | | | | |
|---|---|---|---|---|
| 2,157,423 | A | 5/1939 | Moriarty | |
| 2,563,751 | A * | 8/1951 | Rossi | A43B 23/085 36/114 |
| 3,175,310 | A | 3/1965 | MacQuaid | |
| 4,342,159 | A * | 8/1982 | Edwards | A43C 13/14 36/77 R |
| 4,908,963 | A | 3/1990 | Krajcir et al. | |
| 5,457,898 | A | 10/1995 | Fortin et al. | |
| 6,286,234 | B1 * | 9/2001 | Smith, Jr. | A43B 5/145 36/7.4 |
| 7,328,526 | B2 * | 2/2008 | Peterson | A43B 7/32 36/77 R |
| 8,490,300 | B1 | 7/2013 | Houston, III | |
| D883,649 | S * | 5/2020 | Huang | D2/979 |
| 10,743,622 | B2 * | 8/2020 | Yeh | A43B 7/08 |
| D924,545 | S * | 7/2021 | Lu | A43B 23/085 D2/909 |
| 11,151,580 | B2 * | 10/2021 | Cooper | G06Q 50/265 |
| 2008/0148607 | A1 | 6/2008 | Spar et al. | |
| 2015/0040440 | A1 * | 2/2015 | Tozzi | A43B 5/02 12/142 P |

OTHER PUBLICATIONS

"2 Pairs Shoes Crease Protector Toe Box, Prevent Sneaker Shoes Crease Protector for Men and Women 5-12", Amazon.com. https://www.amazon.com/dp/B07SCZWSYY?ref_=cm_sw_r_cp_ud_dp_SVTZ6WAM2PFE9A88NV4 [Date accessed: Apr. 19, 2021].

(Continued)

*Primary Examiner* — Jila M Mohandesi
(74) *Attorney, Agent, or Firm* — Christopher Mayle; Bold IP, PLLC

(57) ABSTRACT

One or more embodiments of a shoe insert are disclosed. A shoe insert includes a body sized and arranged to fit in the toe box of a shoe while not preventing a foot of a wearer from being inserted into the toe box of the shoe if the body is inserted in the toe box of the shoe. The body may include a top portion and side portions. The top portion may extend primarily horizontally. The side portions may extend primarily vertically. The side portions may include a left side portion and a right side portion with the top portion between the left side portion and the right side portion.

8 Claims, 5 Drawing Sheets

(56) References Cited

OTHER PUBLICATIONS

"(1 Pair) The Original Sneaker Shields—'Universal" Shoe Crease Preventer,' Amazon.com. https://www.amazon.com/dp/B00NOUWT02?tag=footnews09-20&linkCode=ogi&th=1&psc=1&language=en_US [Date accessed: Apr. 19, 2021].
"Knitted Protector," Sneakershields.com. https://www.sneakershields.com/shop/knitted-protector/ [Date accessed: Apr. 19, 2021].
"Pre-Notched Sports Shield," Sneakershields.com. https://www.sneakershields.com/shop/pre-notched-sports-shield/ [Date accessed: Apr. 19, 2021].
"GEN-X Protector," Sneakershields.com. https://www.sneakershields.com/shop/gen-x-protector/ [Date accessed: Apr. 19, 2021].
6 Pairs Anti-wrinkle Shoes Crease Protector Toe Box Decreaser, Avoid Shoes Crease Indentation (Black. White, Gray), Amazon.com. https://www.amazon.com/dp/B07YF7WNGV?tag=footnews09-20&linkCode=ogi&th= 1&psc=1&language=en_US [Date accessed: Apr. 19, 2021].
"Brand: DS Armor. Shoe Shields Crease Preventers by DS Armor, Sneaker Toe Box Decreaser Men 7.5-13 / Women 5-9 (Mens 7.5-13)," Amazon.com. https://www.amazon.com/dp/B07QYR528R?tag=footnews09-20&linkCode=ogi&th=1&psc=1&language=en_US [Date accessed: Apr. 19, 2021].
"Comfowner 6 Pairs Shoe Crease Protectors Toe Box Decreaser Prevent Shoes Crease Indentation Anti-Wrinkle Shoes Creases Protector for Men's US Size 7-12," Amazon.com. https://www.amazon.com/dp/B083RW19SZ/ref=as_li_ss_tl?SubscriptionId=AKIAJO7E5OLQ67NVPFZA&ascsubtag=224118606-2-895481923.1604344064&tag= shopperz_origin3-20 [Date accessed: Apr. 19, 2021].
"YOLOPARK Shoe Creases Protector, 4 Pairs Shoe Anti Creases Guard to Prevent Sneaker Creases for Men's 7.5-13 Women's 5-9," Amazon.com. https://www.amazon.com/dp/B07V368HN3/ref=as_li_ss_tl?SubscriptionId=AKIAJO7E5OLQ67NVPFZA&ascsubtag=686063890-2-895481923.1604344064&tag=shopperz_origin3-20 [Date accessed: Apr. 19, 2021].
"2 Pairs Crease Protectors for air Force 1,Anti-Wrinkle Shoe Crease Protector,Crease Guards,Toe Box Crease Protector for Women's 5-8.5/Men's 7-12, Brand: Aduksa," Amazon.com. https://www.amazon.com/dp/B08FZZQ66G/ref=as_li_ss_tl?SubscriptionId=AKIAJO7E5OLQ67NVPFZA&ascsubtag=930393922-2-895481923.1604344064&tag=shopperz_origin3-20 [Date accessed: Apr. 19, 2021].

* cited by examiner

SHOE INSERT

CROSS REFERENCE TO RELATED APPLICATIONS

This application claims priority to U.S. Provisional Application No. 63/279,937, filed on Nov. 16, 2021, which is incorporated by reference in its entirety.

FIELD OF THE DISCLOSURE

The present invention relates to devices for reducing wear in shoes which are inserted into shoes.

BACKGROUND

Shoes generally have a soft upper portion made of leather, fabric, or flexible plastic. The upper portion between the laces and the toes may be called the vamp. The vamp in sneakers often includes a mainly flat piece of leather or flexible plastic forming the top of the toe box. This piece of leather or flexible plastic may be called a vamp piece. Sneakers (and almost all other shoes) bend as the wearer of the shoes walks. The bending of the shoe may cause the vamp piece to bend and eventually form creases in the vamp piece. These creases make the sneakers look old and worn.

In an effort to reduce the creasing of the vamp piece, various inserts have been made. Some of these inserts seek to eliminate the bending of the vamp piece entirely by having a hard inflexible insert that prevents the toe box of the shoe from flexing as the wearer walks. These inserts are uncomfortable for the wearer because the inflexibility of the shoe causes the shoe to feel restrictive and many cause portions of the hard inflexible insert to dig into the foot of the wearer when walking. The hard inserts also often rub against the toes and side of the foot of the wearer.

To compensate for the size of the insert and the inflexibility of the shoe, some people have resorted to buying sneakers that are too large for their feet so their feet will feel less restricted. However, with a larger shoe, the foot moves around in the shoe and the toes end up rubbing against or being jammed against the hard insert which causes more discomfort.

Other shoe inserts seek to reinforce the vamp piece by attaching to the inside of the shoe under the vamp piece in the shape of the vamp piece and without side support that extends down to the sole of the shoe. These inserts are much more comfortable and provide good protection from wear on the vamp piece, but do not maintain the shape of the toe box and wear on the sides of the toe box may not be prevented.

SUMMARY

One or more embodiments are provided below for a device for a shoe insert. The shoe insert may include a body sized and arranged to fit in the toe box of a shoe while not preventing a foot of a wearer from being inserted into the toe box of the shoe if the body is inserted in the toe box of the shoe. The body may include a top portion and side portions. The top portion may extend primarily horizontally. The top portion may include a ridge extending in a first direction. The top portion may be sized and arranged to contact a vamp piece of the toe box of the shoe. The ridge may be sized and arranged to contact the vamp piece of the toe box of the shoe when the body is inserted in the toe box of the shoe. The side portions may extend primarily vertically. The side portions may be sized and arranged to contact a sole of the shoe when the body is inserted in the toe box of the shoe. The top portion may include a forward point which is the furthest point of the body in the first direction. The side portions may include a left side portion and a right side portion with the top portion between the left side portion and the right side portion. Each of the left side portion and the right side portion may include a forward sole contact point and a rear sole contact point. The forward sole contact point may be the furthest point in the first direction arranged to contact the sole of the shoe when the shoe is not flexed and the body is inserted into the toe box. The rear sole contact point may be the furthest point in the direction opposite the first direction arranged to contact the sole of the shoe when the shoe is not flexed and the body is inserted into the toe box. The forward point of the top portion may be further in the first direction than the forward sole contact points of the left side portion and the right side portion.

The device may provide significant advantages over the devices known in the art. The device may provide excellent support for the toe box to maintain its shape and new (unworn) appearance. The device may also provide significant improvements in comfort over existing shoe inserts that preserve the shape of the toe box.

Other advantageous features as well as other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
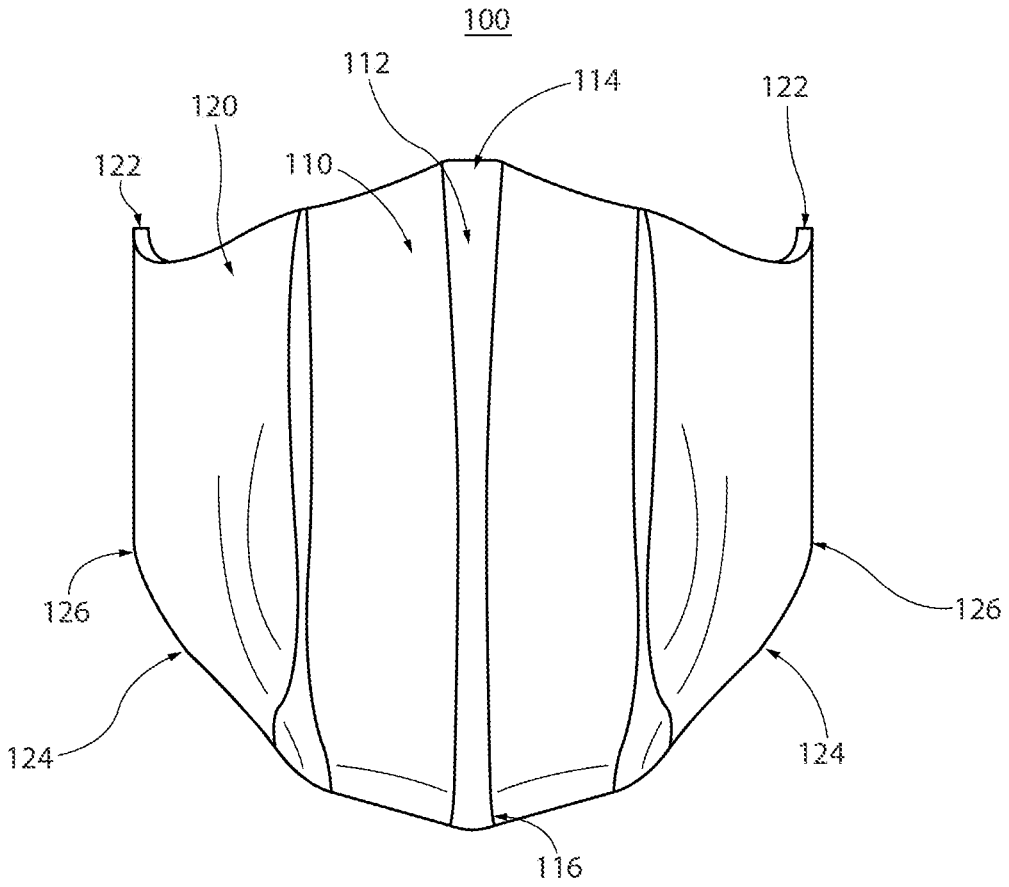
FIG. 1 shows an example top view of a shoe insert.

In the Summary above and in this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

Referring now to the drawings and the following written description of the present invention, it will be readily understood by those persons skilled in the art that the present invention is susceptible to broad utility and application. Many embodiments and adaptations of the present invention other than those herein described, as well as many variations, modifications, and equivalent arrangements will be apparent from or reasonably suggested by the present invention and the detailed description thereof, without departing from the substance or scope of the present invention. This disclosure is only illustrative and exemplary of the present invention and is made merely for purposes of providing a full and enabling disclosure of the invention.

Figure 2:
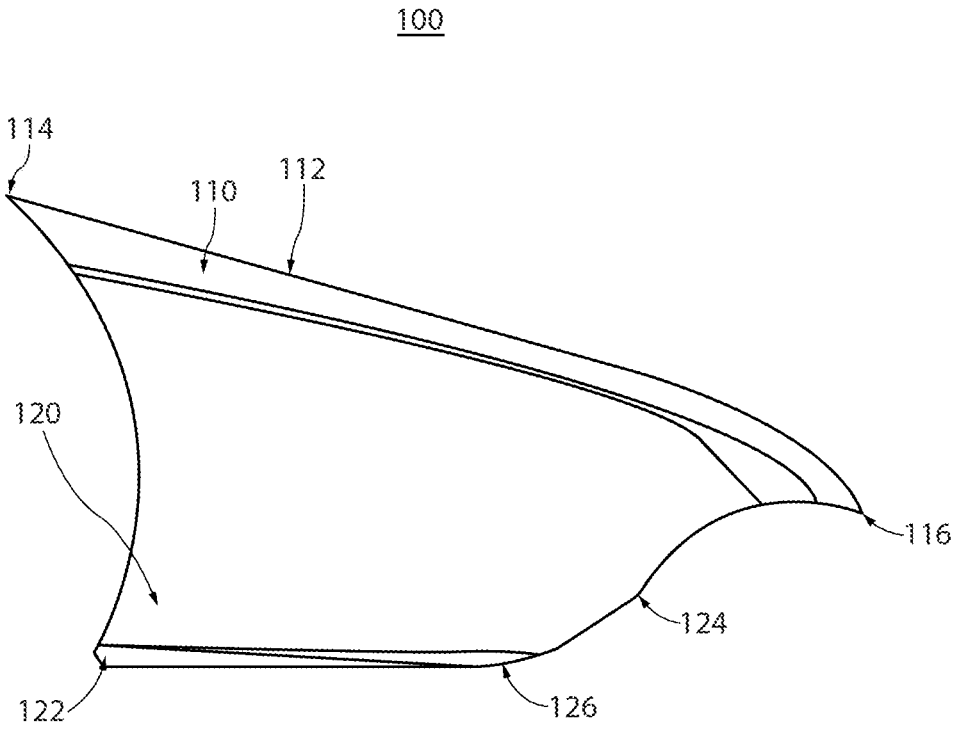
FIG. 2 shows an example side view of a shoe insert.
Figure 3:
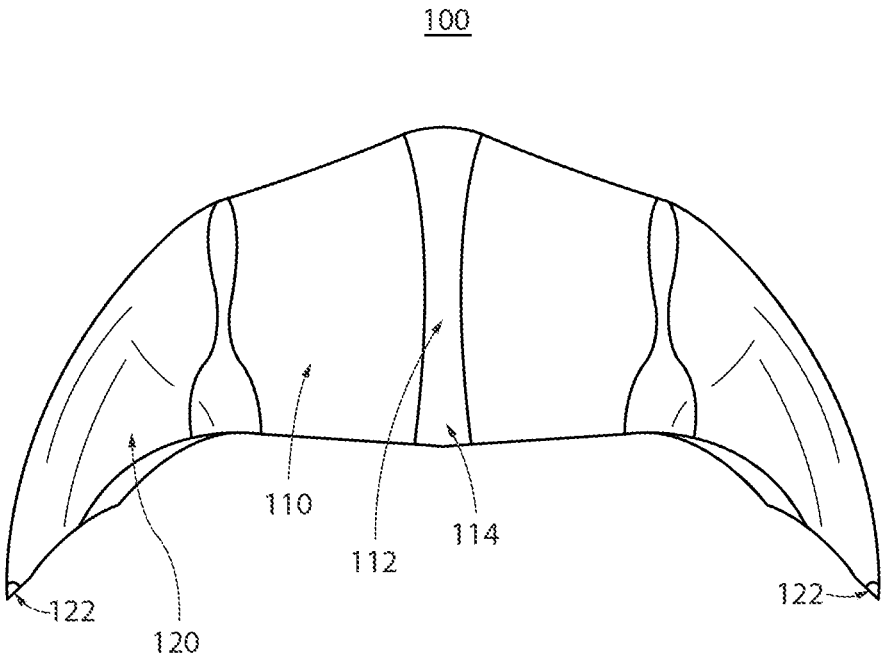
FIG. 3 shows an example back perspective view of a shoe insert.

FIG. 1 shows an example top view of a shoe insert 100. FIG. 2 shows an example side view of the shoe insert 100. FIG. 3 shows an example back perspective view of the shoe insert 100. The shoe insert may have a shape similar to the shape of the toe box of a shoe and have a minimal thickness so it can be inserted into a shoe and the wearer of the shoe can still comfortably put his or her foot into the shoe. The shoe insert may have a thickness of about less than 5 mm. The thickness of the shoe insert may vary between example embodiments and within an embodiment. The shoe insert 100 may include or be made of molded plastic or other durable material suitable for maintaining the shape of a toe box of a shoe while a user walks in the shoe. A body of the shoe insert 100 may include the molded plastic or other durable material.

The shoe insert 100 may include a top portion 110 and side portions 120. The top portion 110 and side portions 120 may form entirely or be part of the body of the shoe insert. The top portion may extend primarily horizontally (left to right and into the page and out of the page of FIG. 2) and the side portions may extend primarily vertically (up and down in the view of FIG. 2). The top portion 110 may decrease in height in a first direction (rightward in FIG. 2). The top portion may include a forward point 116 which is the furthest point forward in the first direction. The top portion may also include a rear point 114 which is the furthest point in the direction opposite the first direction (leftward in FIG. 2). The rate of the decrease in height may accelerate near a front point 116 such that the angle at the front point 116 is the lowest angle below the level of the top portion 110. The rear point 114 may be the highest point of the top portion 110. The front point 116 and the rear point 114 may be about in the middle of the shoe insert in a horizontal direction perpendicular to the first direction (left to right in FIG. 1). The shoe insert 100 may not be symmetrical in the direction perpendicular to the first direction.

The top portion 110 may include a ridge 112. The ridge may be pronounced or smooth. The ridge 112 may be the highest point of the top portion 110 in the direction perpendicular to the first direction for each point in the first direction. The ridge may extend in the first direction from the rear point 114 to the front point 116. The ridge 112 may have a greater thickness than the rest of the top portion 110. Restated, the top portion 110 may have the greatest thickness at the ridge 112.

The side portion 120 may include a left side portion 120 and a right side portion 120. The features of the left side portion 120 and the right side portion 120 may be identical other than slight differences in size and shape to conform to the size and shape of the toe box of the shoe (not shown in these figures). The toe box in most shoes is not symmetrical left to right so in many embodiments the left side portion 120 and the right side portion 120 may not be symmetrical or mirrors of each other. However, the left side portion 120 and the right side portion 120 may have the same major features.

The side portion 120 may extend primarily vertically and the top portion 110 may extend primarily horizontally. The side portion 120 and the top portion 110 may be made of a single molded piece of plastic. The side portions 120 may be portions of the insert 100 that have an outer surface angled below −45 degrees in the direction perpendicular to the first direction. The top portion 110 may be a portion with an outer surface that is angled between 0 and −45 degrees. The top portion 110 may include portions with an outer surface that are below −45 degrees in the first direction (e.g., the front point 116 may have an outer surface with an angle of up to −90 degrees in the first direction).

The side portions may include a forward sole contact point 126 and a rear sole contact point 122 with a bottom surface between the forward sole contact point 126 and the rear sole contact point 122. The bottom surface may be the lowest point in the vertical direction of the side portion between the forward sole contact point 126 and the rear sole contact point 122 in the first direction. The forward sole contact point 126 and the rear sole contact point 122 may have about the same height in the vertical direction and the bottom surface may be substantially flat between the forward sole contact point 126 and the rear sole contact point 122. The forward sole contact point 126 may be a portion of the bottom surface furthest in the first direction and the rear sole contact point 122 may be a portion of the bottom surface furthest in a direction opposite the first direction. The forward point 116 of the top portion 110 may be further in the first direction than the forward sole contact point 126 of the left side portion 120 and the forward sole contact point 126 in the right side portion 120.

The top portion 110, left side portion 120, and right side portion 120 together may define a forward edge which extends from the forward sole contact point 126 of the left side portion 120, to the forward point 116 of the top portion 110, and to the forward sole contact point 126 of the right side portion 120. The forward edge may be higher than the bottom surface of the left side portion 120 or the bottom surface of the right side portion 120. The shoe insert 120 may not extend below the forward edge (i.e., the forward edge may be the lowest point of the shoe insert 110 in the first direction of the front sole contact points 126). The forward edge may include a left mid-point 124 between the forward sole contact point 126 of the left side portion 120 and the forward point 116 of the top portion 110. The forward edge may also include right mid-point 124 between the forward point 116 of the top portion 110 and to the forward sole contact point 126 of the right side portion 120. The mid-points 124 may be located at about the transition between the top portion 110 and the side portions 120. The forward edge may be convex between the mid-point 124 and the forward sole contact point 126. The forward edge may be concave between the left mid-point 124 and the forward point 116 and concave between the right mid-point 124 and the forward point 116.

The top portion 110, left side portion 120, and right side portion 120 together may define a rear edge. The rear edge (or back edge) may be points of the shoe insert 100 that are furthest in the direction opposite the first direction. The back edge may extend from the left rear sole contact point 122 to the rear point 114 of the top portion 110 to the right rear sole contact point 122. The rear edge may be concave between the rear sole contact point 122 and the rear point 114.

Figure 4:
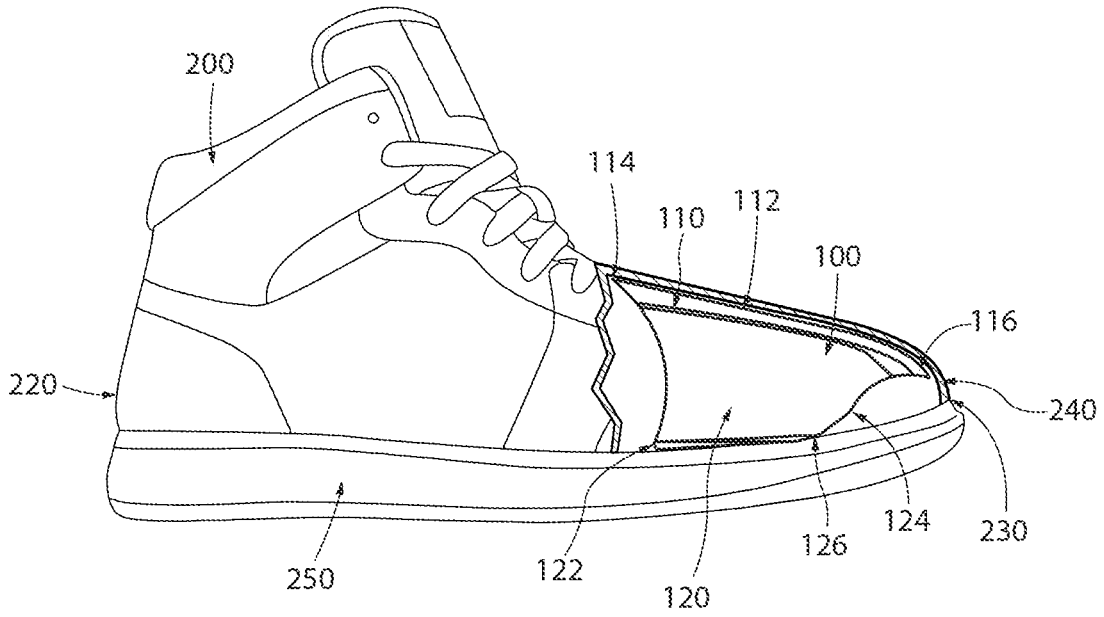
FIG. 4 shows an example side view of a shoe with the shoe insert in the toe box of the shoe.
Figure 5:
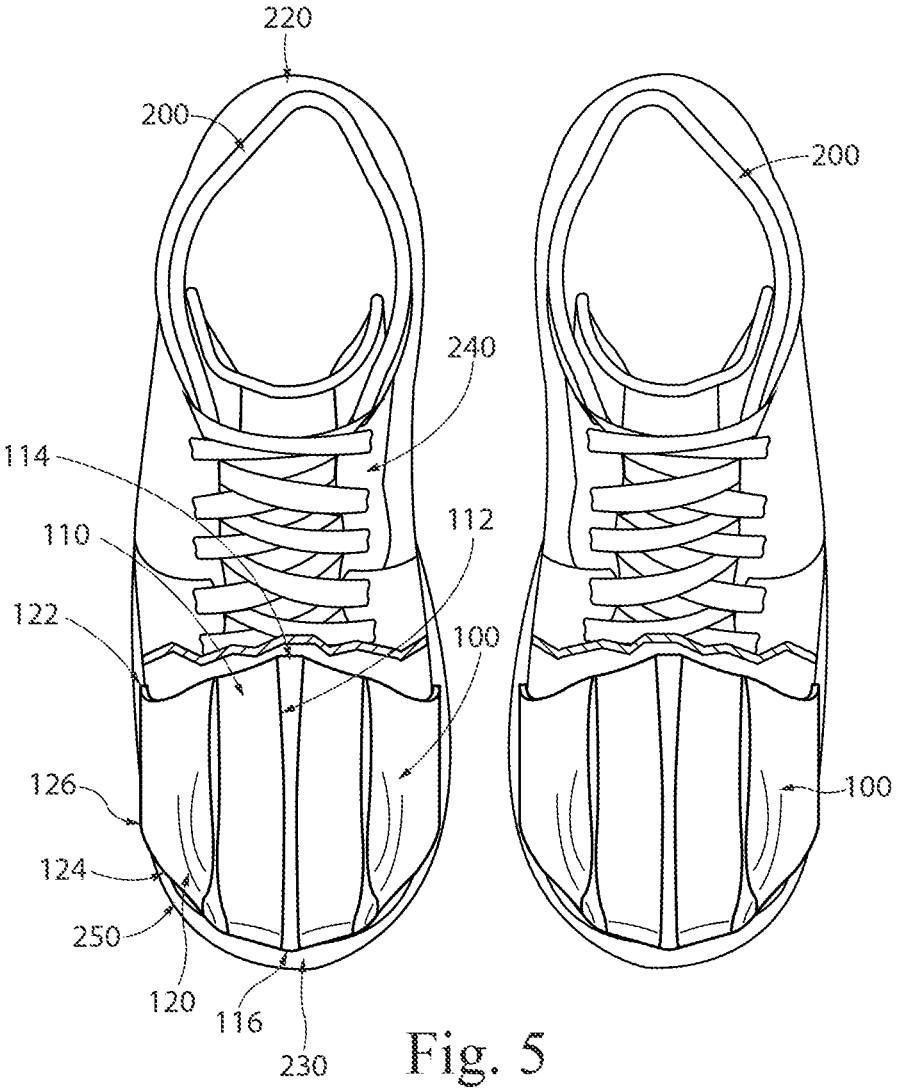
FIG. 5 shows an example top view of a pair of shoes with shoe inserts inserted in the toe boxes of the shoes.

FIG. 4 shows an example side view of a shoe 200 with the shoe insert 100 in the toe box of the shoe 200. FIG. 5 shows an example top view of a pair of shoes 200 with shoe inserts 100 inserted in the toe boxes of the shoes 200. The shoe insert 100 for the left shoe 200 may be the mirror of the shoe insert for the right shoe 200. The shoes 200 may include soles 250 and uppers 240. The uppers 240 and soles 250 may define a toe 230 and heal 220 of the shoe. The area of the upper 240 arranged to go around the toes of the foot of the wearer may be the toe box. In FIGS. 4 and 5 the portion of the shoe above the inserted shoe insert 100 is not shown in order to show the features of the insert in the shoe 200. The shoe insert 100 may be sized and arranged to fit in the toe box of the shoe 200 while not preventing a foot of a wearer from being inserted into the toe box of the shoe 200 if the shoe insert 100 is already inserted in the toe box of the shoe 200.

The toe box may include a vamp piece, which is a piece of material that may be directly above the toes of the wearer and may be flat and extending primarily horizontally. The top portion 110 may be sized and arranged to contact the vamp piece of the toe box of the shoe. The ridge 112 may be sized and arranged to contact the vamp piece of the toe box of the shoe when the shoe insert 100 is interested in the toe box of the shoe 200. The top portion 110 and the ridge 112 may support the structure of the toe box of the shoe while a wearer is walking and prevent creasing in the vamp piece and sides of the toe box.

The primary way that walking creases the vamp piece of the upper 240 is that the sole 250 bends with the foot during the walking motion. The bending of the sole primarily bends the toe 230 upward and make the upper 240 fold or crease under the pressure of the upturned toe. The insert 100 may decrease the amount the toe 230 can bend up by the forward point 116 contacting the sole 250 or contacting the toes of the foot which contacts the sole 250. In this way, the worst of the creasing may be prevented by not allowing too much movement of the toe 230 of the shoe 200. However, allowing no movement of the toe 230 would be uncomfortable for the foot of the wearer. Some movement of the toe 240 and some bending pressure on the upper 240 may still be allowed by the shoe insert due to the forward edge being shaped and arranged to not contact the sole 250 when the shoe is not flexed. To prevent damage from this reduced movement, the ridge 112 of the upper portion 110 may cause the upper to have a supported slight bend in the direction perpendicular to the first direction (left to right in FIG. 5). This bend in the material of the direction perpendicular to the first direction makes the material resistant to bending and creasing due to bending pressure in the vertical direction from the toe 230. The combination of the structure preventing bending and providing a bend to the material to increase resistance to creasing in the first direction causes the shoe insert to significantly reduce wear and creasing while allowing a comfortable amount of movement for the wearer.

The front edge is arranged to not contact the toes of the wearer during walking. When walking, a person's foot tends to be pushed forward on impact with the ground and slide back toward the heel 220 when the toes bend and the foot is lifted. The front edge may be arranged to allow the toes to slide forward under the front edge when the foot contacts the ground so the toes do not contact a hard surface. The shoe insert 100 may also have a soft padding on the interior of the insert 100 to provide a softer contact with the foot of the wearer. The front edge may be more over the big toe and second toe of the foot of the wearer than over the other three toes to prevent uncomfortable contact with the big toe or first toe which are the most likely to slide forward and contact the upper 240 of the shoe 200 at the toe 230. In some embodiments, the forward point 116 may be arranged to contact the sole 250 when the shoe is flexed and may be arranged to be directly in the first direction in front of the third, fourth, or fifth toes (i.e., not in front of the big toe or first toe). As an example, FIG. 1 may show an example right shoe insert with the forward point 116 arranged to be over the third toe of the foot.

The concave shape of the forward edge between the forward sole contact point 126 and the mid-point 124 allows for some movement of the toe 230 vertically and causes the sole 250 to not bend at a single point to prevent or reduce damage to sides of the toe box material of the upper 240. The forward sole contact point 126 may be arranged to be about even with the first joint of the toes of the foot of the wearer and the bend in the sole 250 can match the bend in the foot/toes. The convex shape of the forward edge between the mid-point 124 and the forward point 116 arranges the forward edge of the shoe insert to not pinch the toes of the person as the foot and shoe move in the walking motion.

Many different embodiments of the inventive concepts have been shown. A person of ordinary skill in the art will appreciate that the features from different embodiments may be combined or replaced with other features from different embodiments.

Advantageously, the shoe insert 100 may provide excellent support for the toe box of a shoe 200 to maintain its shape and new (unworn) appearance. The shoe insert 100 may also provide significant improvements in comfort over existing shoe inserts that preserve the shape of the toe box.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A shoe insert comprising:

a body sized and arranged to fit in a toe box of a shoe the body including:

a bottom portion;

a top portion wherein the top portion extends downward from a rear edge to a front edge, wherein the front edge positioned at a front of the shoe, wherein the front edge is a most forward point of the shoe insert, wherein the rear edge is a highest point and most rearward point of the shoe insert, wherein the top portion has a first area and second area, the first area between the rear edge and the second area, the second area between the first area and the front edge, wherein the first area is a diagonal straight line or a diagonally substantially straight line, wherein the second area is a diagonal downward curved line that is concave in shape; and side portions wherein the side portions connect to and are positioned between the bottom portion to the top portion, the side portions include a left side portion and a right side portion with the top portion between the left side portion and the right side portion, each of the left side portion and the right side portion, wherein the rear edge of the top portion, a rear edge of the bottom portion, and rear edges of the side portions form a rear surface, wherein the rear surface is concave in shape extending frontward from the rear edge of the top portion and the rear edge of the bottom portion, wherein a front edge of the side portions connect a front edge of the bottom portion and a front edge of the top portion, wherein the front edge of the side portions has a first section and a second section, the first section positioned between the front edge of the top portion and the second section, the second section positioned between the front edge of the bottom portion and the first section, wherein the first section is a concave portion directed rearward from the front edge of the top portion.

2. The shoe insert of claim 1, wherein a maximum thickness of the body is under about 5 millimeters.

3. The shoe insert of claim 1, wherein the bottom portion is sized and arranged to not contact a front of the shoe.

4. The shoe insert of claim 1, wherein the bottom portion does not extend past the second area of the top portion in a forward direction.

5. A shoe insert comprising:

a top portion extending primarily horizontally, the top portion including a ridge extending in a first direction;

wherein the top portion extends outward into two side portions, the two side portions connecting a bottom portion to the top portion, wherein a rear edge of the top portion, a rear edge of the bottom portion, and rear edges of the two side portions form a rear surface, wherein the rear surface is concave in shape in a forward direction extending between the rear edge of the top portion and the rear edge of the bottom portion such that the rear edge of the top portion and the rear edge of the bottom portion are more to a rear of the shoe insert than a rear of the two side portions, wherein the top portion spans a longer horizontal length than the bottom portion.

6. The shoe insert of claim 5, wherein a maximum thickness of the top portion is under about 5 millimeters.

7. A shoe insert comprising:

a body sized and arranged to fit in a toe box of a shoe while not preventing a foot of a wearer from being inserted into the toe box of the shoe if the body is inserted in the toe box of the shoe, the body including:

a top portion, a bottom portion, and two side portions, the two side portions connecting and positioned completely between bottom portion to the top portion on a vertical axis, wherein the top portion extends diagonally downward ending at a front edge, wherein a front edge of the two side portions connect a front edge of the bottom portion and a front edge of top portion, wherein the front edge of the two side portions has a first section a second section, the first section positioned between the front edge of the top portion and the second section, the second section positioned between the front edge of the bottom portion and the first section, wherein the first section of the two side portions is a concave portion directed in a rear direction from the front edge of the top portion, wherein the second section of the two side portions is a diagonally straight portion or substantially diagonally straight portion directing further in the rear direction, wherein the top portion spans a horizontal length equal to the first section, the second section, and the bottom portion.

8. The shoe insert of claim 7, wherein the top portion includes a ridge extending in a first direction, wherein the top portion is sized and arranged to contact a vamp piece of the toe box of the shoe and the ridge is sized and arranged to contact the vamp piece of the toe box of the shoe when the body is inserted in the toe box of the shoe.

* * * * *